US007789062B2

(12) United States Patent
Cooke

(10) Patent No.: US 7,789,062 B2
(45) Date of Patent: Sep. 7, 2010

(54) INJECTION NOZZLE

(75) Inventor: Michael Peter Cooke, Gillingham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 83 days.

(21) Appl. No.: 12/315,834

(22) Filed: Dec. 5, 2008

(65) Prior Publication Data

US 2009/0145401 A1 Jun. 11, 2009

(30) Foreign Application Priority Data

Dec. 10, 2007 (EP) ..... 07122792

(51) Int. Cl.
*F02B 3/00* (2006.01)
*F02M 39/00* (2006.01)

(52) U.S. Cl. ..... 123/299; 123/300; 239/533.1; 239/533.3

(58) Field of Classification Search ..... 123/299, 123/300; 239/533.1–533.12
See application file for complete search history.

(56) References Cited

U.S. PATENT DOCUMENTS

| | | | | |
|---|---|---|---|---|
| 5,899,389 | A * | 5/1999 | Pataki et al. | 239/533.2 |
| 6,220,528 | B1 * | 4/2001 | Cooke et al. | 239/533.3 |
| 6,565,017 | B1 * | 5/2003 | Fath et al. | 239/533.3 |
| 6,758,407 | B1 * | 7/2004 | Lambert et al. | 239/5 |
| 7,243,862 | B2 * | 7/2007 | Dingle | 239/533.2 |
| 7,347,389 | B2 * | 3/2008 | Ohnmacht et al. | 239/584 |
| 7,360,722 | B2 * | 4/2008 | Stockner et al. | 239/533.12 |
| 7,364,099 | B2 * | 4/2008 | Boecking | 239/533.12 |
| 7,404,526 | B2 * | 7/2008 | Cooke et al. | 239/533.11 |
| 7,568,634 | B2 * | 8/2009 | Cooke | 239/96 |
| 7,578,450 | B2 * | 8/2009 | Stockner et al. | 239/1 |
| 2002/0179743 | A1 * | 12/2002 | Haeberer et al. | 239/533.12 |
| 2005/0224605 | A1 * | 10/2005 | Dingle | 239/533.2 |

(Continued)

FOREIGN PATENT DOCUMENTS

| | | |
|---|---|---|
| DE | 102 45 735 | 4/2004 |

(Continued)

OTHER PUBLICATIONS

European Search Report dated Mar. 28, 2008.

*Primary Examiner*—Thomas N Moulis
(74) *Attorney, Agent, or Firm*—Thomas N. Twomey

(57) ABSTRACT

An injection nozzle for a compression ignition internal combustion engine, the injection nozzle comprising: a nozzle body provided with a bore, within which a unitary valve needle is movable along a primary valve needle axis, the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the bore than said relieved region, said second outlet being disposed downstream of the fourth valve region.

20 Claims, 3 Drawing Sheets

U.S. PATENT DOCUMENTS

| | | | | |
|---|---|---|---|---|
| 2009/0134246 | A1* | 5/2009 | Cooke et al. | 239/533.12 |
| 2009/0283612 | A1* | 11/2009 | Grant et al. | 239/533.11 |

FOREIGN PATENT DOCUMENTS

| | | |
|---|---|---|
| EP | 1 555 430 | 7/2005 |
| GB | 1 293 088 | 10/1972 |
| JP | 59 147864 | 8/1984 |
| WO | 2004/074677 | 9/2004 |

* cited by examiner

INJECTION NOZZLE

TECHNICAL FIELD

The present invention relates to an injection nozzle for use in a fuel injection system for an internal combustion engine. It relates particularly, but not exclusively, to an injection nozzle for use in a common rail fuel injection system for an internal combustion engine, and an injection nozzle wherein a valve needle of the injection nozzle is controlled by a piezoelectric actuator.

BACKGROUND TO THE INVENTION

In common rail fuel injection systems, a plurality of injectors are typically provided to inject fuel at high pressure into the cylinders of an internal combustion engine. Each injector includes an injection nozzle having a valve needle that is operated by an actuator so as to move towards and away from a valve seating and to control fuel delivery by the injector. It is known that an optimum exhaust emission condition may be achieved if the rise and fall of the injection rate, at the beginning and end of injection, respectively, is as fast as possible, necessitating fast movement of the injection nozzle valve needle. Indirect acting injectors typically do not provide a fast needle response as they rely on a servo valve to control operation of the valve needle. Direct-acting piezoelectric injectors, however, are known to provide a fast needle response. In a direct-acting piezoelectric injector the actuator acts directly on the valve needle through a hydraulic and/or mechanical motion amplifier. Our European patent EP 0995901 describes a direct-acting piezoelectric injector of the aforementioned type.

One disadvantage of direct-acting injectors is that they are relatively inefficient, electrically, due to the large amount of electrical energy that is required to produce sufficiently high needle lift. In addition to direct loss of energy, the life of the piezoelectric actuator is also compromised due to the large amounts of energy required to drive the actuator.

It is an object of the present invention to provide an injection nozzle that addresses the aforementioned problem so as to enable energy efficiency to be improved when implemented, for example, in a direct-acting piezoelectric injector.

SUMMARY OF INVENTION

According to a first aspect of the invention, an injection nozzle is provided for a compression ignition internal combustion engine, the injection nozzle comprising: a nozzle body provided with a bore, within which a unitary valve needle is movable along a primary valve needle axis (A-A), the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the bore than said relieved region, said second outlet being disposed downstream of the fourth valve region.

By providing an injection valve having the above-described configuration, an advantageously high rate of fuel flow through the first and second outlets may be achieved with a relatively small amount of needle lift. Accordingly, the energy required to drive the injection valve may be kept to a minimum, and wear and tear experienced by the valve needle may be reduced. Furthermore, the above-mentioned advantages may be achieved by using a unitary valve needle having a simple construction. Thus, the manufacturing costs are less compared to the costs associated with more complex variable orifice nozzles.

In an exemplary embodiment, the fourth valve region defines a second seat region with the inner surface of the bore when the nozzle is in the non-injecting state.

Conveniently, the fourth valve region may be formed of two sections and each section may be of substantially frusto-conical form.

Alternatively, the injection nozzle may comprise a second exit volume defined between the valve needle and the bore, downstream of the fourth valve region, and into which fuel flows once it has flowed past the fourth valve region when the valve needle is in the injecting state, and wherein the fourth valve region is of part-spheroidal form to define a smooth transition for a diverging fuel flow into the second exit volume, thereby minimizing turbulence within the second exit volume.

At least one of the first, second and third valve regions may be of substantially frusto-conical form.

In an exemplary embodiment, the first seat region defined by the transition between the first and second valve regions is of part-spheroidal form to define a smooth transition for a diverging fuel flow into the first exit volume, thereby to minimize turbulence within the first exit volume.

In an exemplary embodiment, the first and/or the second outlet comprises a plurality of rectilinear openings in the nozzle body spaced radially with respect to the primary needle axis (A-A). The first and second outlets may be parallel, diverging or converging.

According to a second aspect of the invention, a direct-acting fuel injector has an actuator and an injection nozzle of the invention, wherein the actuator is configured to control movement of the valve needle of the nozzle towards and away from the valve seating.

In an exemplary embodiment, said actuator is a piezoelectric actuator.

According to a third aspect of the present invention, an injection nozzle for a compression ignition internal combustion engine comprises:

a nozzle body provided with a bore, within which a unitary valve needle is movable along a primary valve needle axis (A-A), the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the valve seating than said relieved region, said second outlet being disposed downstream of the fourth valve region.

According to a fourth aspect of the present invention, there is provided an injection nozzle for a compression ignition internal combustion engine, the injection nozzle comprising:

a nozzle body provided with a bore, within which a unitary valve needle is movable along a primary valve needle axis (A-A), the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the valve seating than said relieved region, said second outlet being disposed downstream of the fourth valve region, the injection nozzle further comprising a second exit volume, defined between the valve needle and the bore downstream of the fourth valve region, and into which fuel flows once it has flowed past the fourth valve region when the valve needle is in the injecting state, wherein the fourth valve region is of part-spheroidal form to define a smooth transition for a diverging fuel flow into the second exit volume, thereby to minimize turbulence within the second exit volume.

Preferred and/or optional features of the first, third and fourth aspects of the invention may be incorporated within the fuel injector of the second aspect, alone or in appropriate combination.

BRIEF DESCRIPTION OF DRAWINGS

The invention will now be described, by way of example only, with reference to the accompanying drawings, in which.

DETAILED DESCRIPTION OF PREFERRED EMBODIMENTS

The injection nozzle of the present invention is of the type suitable for implementation within an injector having a piezoelectric actuator for controlling movement of an injection nozzle valve needle. The injector is typically of the type used in common rail fuel injection systems for internal combustion engines (for example compression ignition—diesel—engines). It is a particular advantage of the invention that the nozzle can be used in direct-acting piezoelectric injectors, wherein the piezoelectric actuator controls movement of the valve needle through a direct action, either via a hydraulic or mechanical amplifier or coupler, or via a direct connection.

Figure 1:
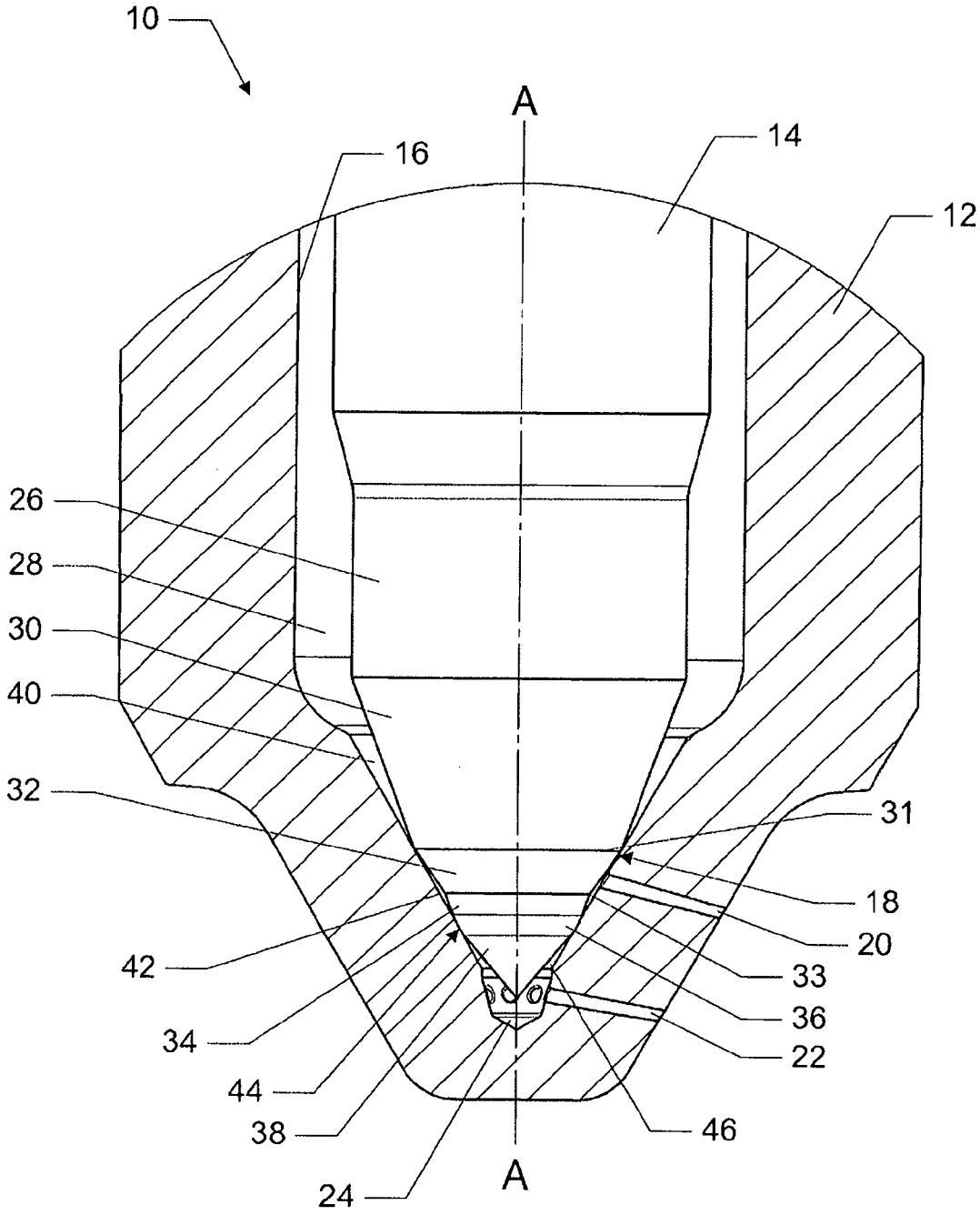
FIG. 1 is a sectional view of a part of an injection nozzle in a non-injecting state.
Figure 2:
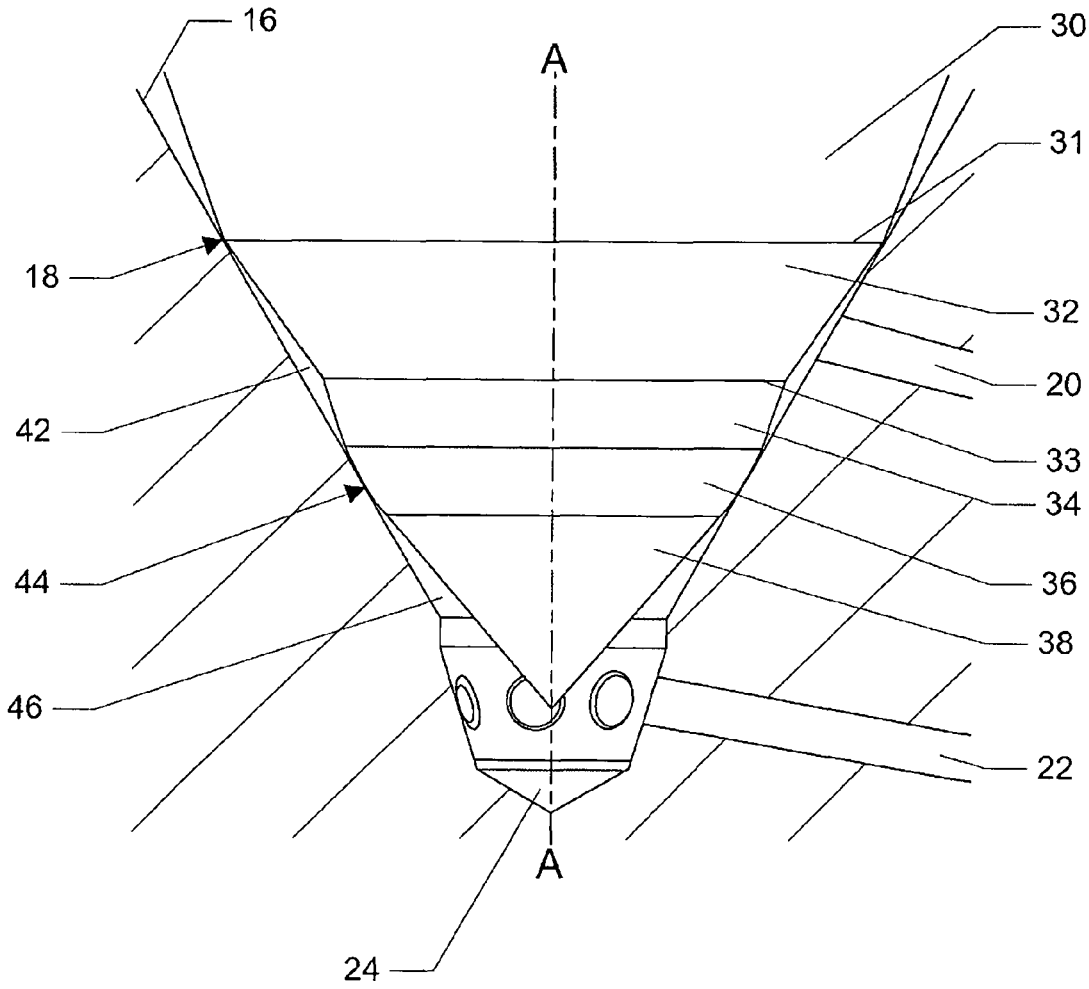
FIG. 2 is an enlarged view of the valve seating in FIG. 1.

Referring to FIGS. 1 and 2, an injection nozzle 10, comprises a nozzle body 12 and a valve needle 14. Nozzle body 12 is provided with a blind bore 16, within which valve needle 14 is movable to engage with, and disengage from, a valve needle seating 18 defined by a blind end of bore 16. Valve seating 18 may be of substantially frusto-conical form, as is known in the art.

Nozzle body 12 also includes respective first and second sets of nozzle outlets 20, 22, through which fuel can be injected into the associated engine cylinder or combustion space, in circumstances wherein valve needle 14 is lifted from its seating 18. The blind end of bore 16 defines a sac volume 24, with which inlet ends of the second set of nozzle outlets 22 communicate.

Although in FIG. 1 a single outlet is shown in each set of outlets 20, 22, typically each set 20, 22 will include a plurality of outlets spaced radially around the nozzle body 12. Therefore, for the purposes of this specification, reference to an 'outlet' should be taken to mean one or more outlets.

First and second outlets 20, 22 may be of equal size and number, or may be of different sizes and/or numbers. Furthermore, as shown in FIG. 1, first and second outlets may each comprise a rectilinear opening formed in the nozzle body 12. First and second outlets 20, 22 may each have flared outlet ends (not shown). First and second outlets 20, 22 may be aligned parallel to one another, converging or diverging.

Valve needle 14 includes an upper region 26 of cylindrical form that defines, together with the internal bore surface, upstream of the valve seating 18, a delivery chamber 28 for receiving high pressure fuel from an inlet (not shown) to the injector, of which the nozzle forms a part. Adjacent to the upper region 26, and located further downstream, the needle includes a first region 30 of substantially frusto-conical form (referred to as the entry region 30 of the nozzle) and, further downstream still, a second region 32 of substantially frusto-conical form. Entry region 30 of the valve needle 14 defines, together with the bore 16, an entry volume 40 for fuel in communication with delivery chamber 28. A transition edge between first and second regions 30, 32 forms a first seat region 31 that seats against the valve seating 18 when the needle is in the non-injecting state.

Adjacent to, and downstream from, second region 32, the needle includes third and fourth regions 34, 36. Third valve region 34 is of substantially frusto-conical form. Fourth valve region 36 is part-spheroidal. The needle terminates in a valve tip 38 downstream of fourth region 36.

A transition region between the second and third regions 32, 34 is spaced from the surface of the bore 16 so as to define a relieved region or groove 33 in the needle 14. A first exit volume 42 is defined by the space between the relieved region 33 of valve needle 14 and the surface of bore 16. The relieved region 33 is arranged such that first exit volume 42 is disposed adjacent to the inlet end of first outlet 20 when valve needle 14 is in an injecting state, as shown in FIG. 3.

Fourth region 36 is closer to the surface of the bore 16 than relieved region 33. A second exit volume 46 is defined by a space between valve tip 38 and a surface of bore 16.

In the embodiment of the invention shown in FIG. 1, fourth region 36 advantageously forms a second seat 44 with a surface of bore 16 when valve needle 14 is in the non-injecting state. With this configuration, impact forces experienced by valve needle 14 as it moves into a non-injecting position are distributed between first seat region 31 formed by the transition edge between first and second regions 30, 32, and the second seat 44 formed by fourth region 36. Second seat 44 also ensures that dead volume in the nozzle is minimized. More specifically, any un-oxidized fuel that remains downstream of the first seat region 31 after injection may subsequently be expelled and contribute to increased hydrocarbon emissions. Accordingly, by keeping free volume in valve seating 18 to a minimum, emission of undesirable hydrocarbons may be reduced. Still another advantage of second seat 44 is that the inlet end of first outlet 20 is isolated from the inlet end of second outlet 22 when valve needle 14 is in a non-injecting position. This minimizes the risk of combustion gas (e.g., oxidized fuel) flowing back into injection nozzle 10 after combustion.

Figure 3:
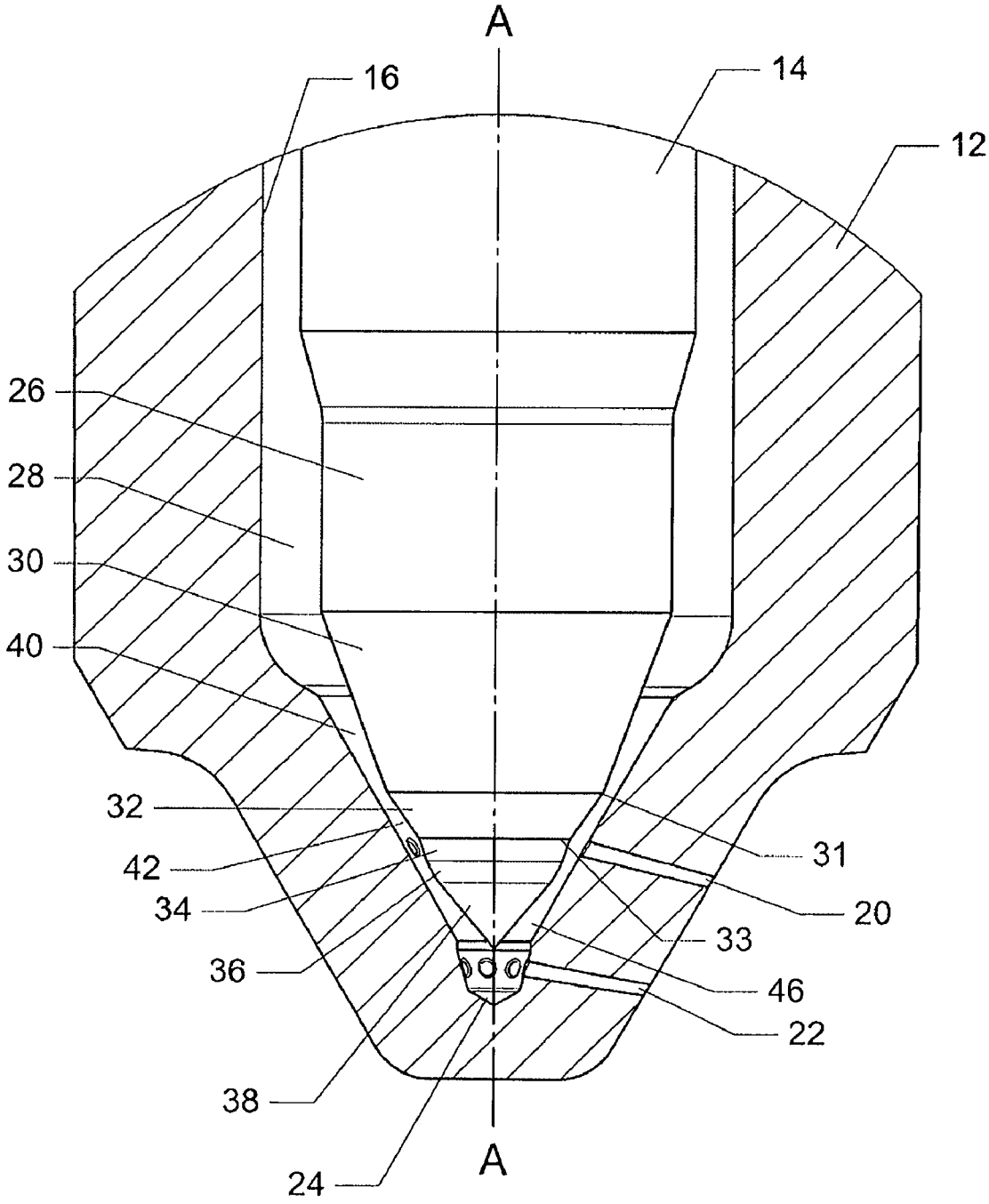
FIG. 3 is a sectional view of the injection nozzle in FIG. 1 when in an injecting state.

Referring to FIG. 3, when valve needle 14 is actuated to lift from valve seating 18 by the piezoelectric actuator, fuel delivered to delivery chamber 28 and entry volume 40 is able to flow past uncovered valve seating 18 and into first exit volume 42. A portion of the fuel flows from first exit volume 42 through first outlet 20. For example, 50% of the fuel in first exit volume 42 may flow through first outlet 20. The remaining portion of the fuel flows from first exit volume 42, past fourth region 36 and into second exit volume 46, from where it flows into the sac volume 24 and out through second outlet 22.

Since a portion of the fuel in first exit volume 42 flows out through first outlet 20, less flow area is required for the remaining portion of fuel to flow from first exit volume 42, past fourth region 36 of the valve needle, to sac volume 24. Accordingly, fourth region 36 may be disposed sufficiently close to the surface of bore 16 so as to avoid unnecessary diffusion of the fuel as it flows from first exit volume 42. As mentioned previously, by providing fourth region 36 near a surface of bore 16, dead volume around valve needle 14 is minimized. Valve needle tip 38 is shaped so as to optimize the flow velocity of fuel through second exit volume 46 and into sac volume 24, in order to minimize pressure losses at second outlet 22.

Nozzle 10, owing at least in part to its use of a one-piece, or unitary, valve needle, provides an efficient flow geometry that has been found to enable high flow levels for relatively low values of needle lift. As a consequence, energy demand on the injector is reduced so that the nozzle provides a particular advantage when implemented within a direct-acting injector of the type described previously.

In an alternative embodiment of the invention, fourth region 36 does not function as a second seat, and there is a gap between fourth region 36 and the surface of bore 16 when valve needle 14 is in a non-injecting position.

For optimum efficiency, fourth region 36 may be spheroidal (as shown in FIGS. 1, 2 and 3) so as to provide a smooth flow path for fuel flowing into second exit volume 46. By spheroidal, it is meant that the outer surface of fourth region 36, i.e. the region that extends from the intersection with third region 34 above to the intersection with valve tip 38 below, forms part of a spheroid having its centre at a point on the primary axis of the valve needle (A-A). In the case where fourth region 36 is spheroidal, when the valve needle is lifted into the injecting state, pressure losses in the fuel flowing into second exit volume 46 are minimized because there is no sharp transition for the fuel flow as it flows past fourth region 36, so the flow past seating 18 experiences only a smooth and gradual change in flow area and direction. Fuel flowing past fourth region 36 into second exit volume 46 and then into sac volume 24 is therefore able to recover, in an efficient manner, a relatively high pressure level prior to reaching second outlet 22. Fourth region 36 may alternatively be formed by two frusto-conical sections, wherein the transition edge between the two sections may form second seat 44.

Although first seat region 31 of the present embodiment is illustrated in FIGS. 1 and 2 as the intersection or transition edge of frusto-conical sections, it may also be formed as a spheroid, similar to fourth region 36. In the case that first seat region 31 is spheroidal, when the valve needle is lifted into the injecting state, pressure losses in the fuel flowing into first exit volume 42 are minimized because there is no sharp transition for the fuel flow as it flows past uncovered valve seating 18, so the flow past seating 18 experiences only a smooth and gradual change in flow area and direction. Fuel flowing past valve seating 18 into first exit volume 42 is, therefore, able to recover, in an efficient manner, a relatively high pressure level prior to reaching first outlet 20.

Relieved region 33 is illustrated as the intersection of conical sections, but may also be formed by the intersection of suitable combinations of cylindrical, spheroidal, radiussed and/or frusto-conical sections.

Valve tip 38 is illustrated as conical, but may also be formed from spheroidal, radiussed or frusto-conical sections. It may also be formed with a chamfered tip.

The invention claimed is:

1. An injection nozzle for a compression ignition internal combustion engine, the injection nozzle comprising:

a nozzle body provided with a bore, within which a unitary valve needle is movable along a primary valve needle axis, the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the bore than said relieved region, said second outlet being disposed downstream of the fourth valve region.

2. An injection nozzle according to claim 1, wherein said fourth valve region defines a second seat region with the inner surface of the bore when the nozzle is in the non-injecting state.

3. An injection nozzle according to claim 1, comprising a second exit volume that is defined between the valve needle and the bore downstream of the fourth valve region and into which fuel flows once it has flowed past the fourth valve region when the valve needle is in the injecting state, wherein the fourth valve region is of part-spheroidal form to define a smooth transition for a diverging fuel flow into the second exit volume, thereby to minimize turbulence within the second exit volume.

4. An injection nozzle according to claim 1, wherein said fourth valve region is formed of two sections and each section is of substantially frusto-conical form.

5. An injection nozzle according to claim 1, wherein at least one of the first, second and third valve regions is of substantially frusto-conical form.

6. An injection nozzle according to claim 1, wherein the first seat region defined by the transition between the first and second valve regions is of part-spheroidal form to define a smooth transition for a diverging fuel flow into the first exit volume, thereby to minimize turbulence within the first exit volume.

7. An injection nozzle according to claim 1, wherein the first and/or the second outlet comprises a plurality of rectilinear openings in the nozzle body spaced radially with respect to the primary needle axis.

8. An injection nozzle according to claim 7, wherein the first and second outlets are parallel, diverging or converging.

9. A direct-acting fuel injector having an actuator and an injection nozzle according to claim 1, wherein the actuator is configured to control movement of the valve needle of the nozzle towards and away from the valve seating.

10. A direct-acting fuel injector according to claim 9, wherein said actuator is a piezoelectric actuator.

11. An injection nozzle for a compression ignition internal combustion engine, the injection nozzle comprising:

a nozzle body provided with a bore, within which a unitary valve needle is movable along a primary valve needle axis, the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the valve seating than said relieved region, said second outlet being disposed downstream of the fourth valve region.

12. An injection nozzle according to claim 11, wherein said fourth valve region defines a second seat region with the inner surface of the bore when the nozzle is in the non-injecting state.

13. An injection nozzle according to claim 11, wherein said fourth valve region is formed of two sections and each section is of substantially frusto-conical form.

14. An injection nozzle according to claim 11, wherein at least one of the first, second and third valve regions is of substantially frusto-conical form.

15. An injection nozzle according to claim 11, wherein the first seat region defined by the transition between the first and second valve regions is of part-spheroidal form to define a smooth transition for a diverging fuel flow into the first exit volume, thereby to minimize turbulence within the first exit volume.

16. An injection nozzle for a compression ignition internal combustion engine, the injection nozzle comprising:

a nozzle body provided with a bore, within which a unitary valve needle is movable along a primary valve needle axis, the valve needle being engageable with a valve seating defined by the bore to control fuel delivery through first and second outlets, and including a first valve region, a second valve region and a first seat region defined by a transition between the first and second valve regions that seats against the valve seating when the nozzle is in a non-injecting state, wherein the valve needle comprises a third valve region, a relieved region defined by a transition between said second and third valve regions, the relieved region defining a first exit volume between the valve needle and the bore adjacent to the first outlet when the valve needle is lifted from the valve seating into an injecting state, and a fourth valve region having at least a part in closer proximity to the valve seating than said relieved region, said second outlet being disposed downstream of the fourth valve region, the injection nozzle further comprising a second exit volume that is defined between the valve needle and the bore downstream of the fourth valve region and into which fuel flows once it has flowed past the fourth valve region when the valve needle is in the injecting state, wherein the fourth valve region is of part-spheroidal form to define a smooth transition for a diverging fuel flow into the second exit volume, thereby to minimize turbulence within the second exit volume.

17. An injection nozzle according to claim 16, wherein said fourth valve region defines a second seat region with the inner surface of the bore when the nozzle is in the non-injecting state.

18. An injection nozzle according to claim 16, wherein said fourth valve region is formed of two sections and each section is of substantially frusto-conical form.

19. An injection nozzle according to claim 16, wherein at least one of the first, second and third valve regions is of substantially frusto-conical form.

20. An injection nozzle according to claim 16, wherein the first seat region defined by the transition between the first and second valve regions is of part-spheroidal form to define a smooth transition for a diverging fuel flow into the first exit volume, thereby to minimize turbulence within the first exit volume.

* * * * *